US006293200B1

(12) United States Patent
Straubinger et al.

(10) Patent No.: US 6,293,200 B1
(45) Date of Patent: Sep. 25, 2001

(54) DRYING METHOD

(75) Inventors: Werner Straubinger, Nuremburg; Richard Kohlmann, Burgtann; Reinhard Lode, Zirndorf; Edwin Munkert, Eckental; Max Herzog, Nuremburg; Rudolf Herb, Bobenheim; Dieter Christmann, Nuremburg, all of (DE)

(73) Assignee: U. E. Sebald Druck und Verlag GmbH, Nuremberg (DE)

( * ) Notice: Subject to any disclaimer, the term of this patent is extended or adjusted under 35 U.S.C. 154(b) by 0 days.

(21) Appl. No.: 09/408,076

(22) Filed: Sep. 29, 1999

(30) Foreign Application Priority Data

Nov. 4, 1998 (DE) ..... 198 50 836

(51) Int. Cl.[7] ..... B41L 35/14
(52) U.S. Cl. ..... 101/488; 101/424.1
(58) Field of Search ..... 101/424.1, 424.2, 101/483, 487, 488; 34/408, 409, 410

(56) References Cited

U.S. PATENT DOCUMENTS 4,150,494 * 4/1979 Rothchild ..... 34/28
5,832,833 * 11/1998 Burgio ..... 101/424.1

FOREIGN PATENT DOCUMENTS 1031321 11/1961 (DE) .
34 16 502 11/1985 (DE) .
28 30 094 2/1988 (DE) .
295 17 181 4/1996 (DE) .
296 13 047 6/1997 (DE) .
197 04 284 10/1998 (DE) .
96 34700 11/1996 (WO) .

OTHER PUBLICATIONS

Werner STRAUBINGER: Sebald 2000–Projekt. In: dw—Druckwelt 6, Jun. 1998, pp. 46 and 47.
R. Mehnert, u.a.: Die Elektronenstrahlhartung von Druckfarben in Leipziger ESH–Rollenoffset–Versuchsanlage erfolgversprechend (II). In: Deutscher Drucker, Nr. 26–27, Jul. 14, 1994, pp. W8, W10, W13–W34.

* cited by examiner

*Primary Examiner*—Ren Yan
(74) *Attorney, Agent, or Firm*—Sughrue, Mion, Zinn, Macpeak & Seas, PLLC

(57) ABSTRACT

In a method of drying inks which are printed on to a paper web in the printing mechanisms of a rotary intaglio printing machine and which are diluted by means of a solvent. the paper web, downstream of each printing mechanism, passes through a drier having a substantially closed housing through which flows a gas which serves to pick up and carry away the solvent. To achieve a reduction in the residual solvent concentration in the finished printed product in spite of an increased speed of the paper web, the drying gas used in at least one of the driers is an inert gas, the through-put thereof through the drier being so selected that a solvent concentration which is very high in comparison with drying with air occurs in the drier.

20 Claims, No Drawings

DRYING METHOD

FIELD OF THE INVENTION

The invention concerns a method of drying the ink which is printed on to a paper web in a printing mechanism of a rotary intaglio printing machine and which has been put into a suitably liquefied form by means of a solvent.

BACKGROUND OF THE INVENTION

A typical method of that kind in which the paper web generally passes in a four-color first-form and perfecting procedure through eight printing mechanisms, downstream of each of which is provided a respective drier, provides that the solvent used to put the ink into a suitably liquid form, generally toluene, is evaporated by means of hot air which flows through the respective drier and serves as an energy carrier, at least to such an extent that, on the freshly printed side, the paper web can be passed over guide or direction-changing rollers without ink being transferred on to same, or that the paper web can be printed upon with another ink in a downstream printing mechanism, without involving smearing and smudging of the ink first applied.

In that respect, for reasons relating to safety engineering, it is not possible to exceed a maximum solvent concentration of 50% of what is known as the 'lower explosion limit', often referred to by the abbreviation LEL, in which case the value of that LEL is dependent on the temperature in the drier. For air which has an oxygen content of about 21%, 50% LEL at 20° C. corresponds to about 21 g/m$^3$ while at 80° C. it is only about 16 g/m$^3$.

Further important parameters in regard to the drying methods in question are the speed at which the paper web passes through the printing mechanisms and the driers, and the length that the individual driers must be so that an adequate drying action can be achieved.

An adequate drying action in that respect not only requires fulfilment of the two conditions referred to above, but also involves a sufficiently low residual solvent content in the finished printed product as the solvent residue quantity which is still contained therein is not to exceed certain specified limits, both for health reasons and also in regard to complying generally with environmental pollution conditions, and also for the reason that otherwise, when folded printed products are laid one upon the other or when a printed paper web which has not yet been cut into pieces is wound on to an intermediate storage roll, the various sheets or layers could stick together, so that the entire production would be rendered useless.

Modern production processes seek to achieve ever increasing paper web speeds and larger and larger paper web widths, but nonetheless the lengths of the driers and the amount of hot air which can be passed through each drier per unit of time cannot be increased just as may be desired. It therefore becomes extremely difficult under those conditions to ensure a drying action which is 'adequate' in the above-indicated sense.

SUMMARY OF THE INVENTION

An object of the present invention is to provide a method of drying ink on a paper web in a printing machine, which ensures an adequate drying action even at very high paper speeds and when wide paper webs are involved.

Another object of the present invention is to provide a method of drying ink applied to a paper web in a printing machine, without requiring driers of extreme length or without involving the passage of very large amounts of drying air through driers.

Still other object of the present invention is to provide a method of drying ink printed on a paper web in a rotary intaglio printing machine, capable of affording enhanced drying of the ink on the web without involving adverse environmental considerations.

Yet a further object of the present invention is to provide a method of drying ink on a paper web printed in a rotary intaglio printing machine, which permits close control of an ink-drying procedure to satisfy the operating demands of the printing process and the printed product.

In accordance with the principles of the present invention the foregoing and other objects are attained by a method of drying the ink which is printed on to a paper web in the printing mechanisms of a rotary intaglio printing machine, being liquefied or suitably diluted by means of a solvent. Downstream of each printing mechanism the paper web passes through a drier which includes a substantially closed housing and through which flows a gas serving to carry away the solvent. The drying gas used in at least one of the driers is an inert gas. The through-put of the inert gas through said drier is so selected that a solvent concentration which is very high in comparison with drying with air occurs in said drier.

PREFERRED EMBODIMENTS AND EXAMPLES

It was realised that. because of the comparatively low, maximum admissible level of solvent concentration in the hot air which was previously used for drying the printed paper web, the solvent is evaporated in particular at the surface of the ink on the web, and that surface very rapidly suffers from a depletion of solvent, that is to say a reduction in the amount of solvent contained at the surface of the ink on the paper, because it is not possible for the amount of solvent which can be transported out of the deeper layers of the ink up to the surface thereof, at a sufficiently rapid rate, to compensate for the solvent which evaporates at the surface of the ink. That effect results in the formation of a gel layer or 'skin' which admittedly provides that. after a short period of time, the printed side of the paper web can be passed over rollers or can be printed upon with a further ink. for which reason the attempt has also previously been made to promote that gel layer formation phenomenon to the maximum extent. On the other hand however this is also the reason for a comparatively high residual amount of solvent in the finished printed product because the gel layer retains solvent in the deeper layers in the ink, and that solvent can subsequently issue therefrom and can detach the surface layer or skin on the ink and has a stressing effect.

In comparison, the method according to the invention provides that the substantially higher level of solvent concentration which is possible by virtue of using an inert gas with a minimum oxygen proportion can effectively prevent or at least alleviate the formation of a gel layer so that drying can be effected starting with the deepest layers of ink, in an upward direction towards the surface. The surface of the ink can be kept moist for a longer period of time so that the condition of equilibrium between a make-up flow involving transportation of solvent out of the deeper layers of ink towards the surface thereof, and the solvent evaporation rate, is maintained. Nonetheless it is possible to achieve such rapid drying even of the ink surface that the freshly printed side of the paper web can be passed over guide or direction-changing rollers, even when very high paper web speeds are involved. without ink being transferred from the paper on to the rollers. The drier sections between the individual printing mechanisms are in that respect so short that the overall dimensions of a rotary intaglio printing machine which includes eight printing mechanisms remain within acceptable limits.

It will be noted that the foregoing considerations in accordance with the invention relate primarily to the driers disposed between the printing mechanisms. It will be noted however that it is also possible in accordance with the invention to operate in those driers in conventional manner with a low level of solvent concentration and without inert gas, and to operate only in the final drier, that is to say the drier which is arranged downstream of the last printing mechanism, with inert gas and a higher level of solvent concentration. In that case, the above-mentioned gel layers may admittedly be formed in the driers which are operated with the low level of solvent concentration, but due to the high level of solvent concentration in the final drier, they are dissolved again at least to such an extent that thorough drying which begins with the deepest layers in the ink and which progresses upwardly towards the surface thereof takes place and thus it is possible to achieve the minimum residual solvent concentration in the finished printed product, that is the aim to be achieved.

A particular advantage of the method according to the invention is that. by virtue of the substantially higher permissible level of solvent concentration, smaller amounts of gas have to be passed through the or each respective drier, whereby the size of the required blowers and cleaning installations which are necessary to separate off the solvent transported out of the respective drier by means of the inert gas is also reduced. In addition. the moist solvent-inert gas atmosphere involves a lesser degree of shrinkage of the paper web which. in conventional drying methods, gives rise to major difficulties and requires complicated and expensive compensatory measures.

So that the energy required for evaporation of the solvent can be transferred into the layers of ink as quickly as possible, the drier involved is preferably equipped with infra-red radiating means. It is possible in that way to manage without a circulating air blower with steam heating. All that is required is a blower of reduced output. which provides for compensation or equalisation of the level of solvent concentration between the surface of the ink and the drying gas, thus only involving transporting it away by convection instead of as hitherto involving convection for applying energy and for transporting it away. Therefore this drying method can also be used in a situation involving an elevated incidence of solvent, that is to say with an elevated paper web speed.

For the toluene/nitrogen system saturation at 20° C. is about 107 g/kg (toluene/nitrogen) and rises at 50° C. to 482 g/kg and at 80° C. even to 2156 g/kg. A desirable drier temperature is in the range of between 50 and 90° C. The solvent content for achieving in-depth drying is preferably in a range of between 50 g/kg and 500 g/kg (toluene/nitrogen).

It is particularly preferable to produce and maintain a solvent gradient in the direction of movement of the paper web over the length of (the drier in the inert gas in such a way that the concentration of solvent in the region of the intake end is higher than in the region in which the paper web leaves the drier or experiences a change in direction for the first time, because in that way on the one hand drying of the ink, which takes place upwardly in the ink, is improved, while on the other hand good thorough drying of the uppermost layers of ink is also guaranteed.

Preferably, the gas boundary layer which would otherwise be formed at the surface of the paper web which moves at high speed and which would be entrained with the paper web is peeled off or removed by turbulence of the gas atmosphere in the drier.

In a preferred embodiment, the inert gas which is loaded with solvent in the drier is removed and preferably depleted or at least partially stripped of its solvent content by being cooled and by the solvent being separated off by virtue of condensation. In that respect cooling can be to a first low temperature of for example 4° C. and the inert gas which is depleted or stripped off in that way, after suitable heating, can be fed to one of the driers again.

In a preferred embodiment, the amount of inert gas which is removed from the drier for depletion of the solvent content and thereafter recycled to the drier again and/or the degree of solvent depletion is so controlled that the level of solvent concentration in the drier or the above-mentioned concentration gradient remains at least substantially constant.

In accordance with a particularly preferred embodiment, the operation of printing on the paper web, prior to drying, also takes place in an inert gas atmosphere. In that respect it is particularly desirable if the inert gas regions in which the paper web is first printed upon and thereafter dried immediately adjoin each other. If after a drying operation further printing is applied to the paper web using another ink, then that printing region which preferably also operates under an inert gas atmosphere is preferably also directly adjoining the inert gas region of the preceding drier.

In this case the printing regions are at least partially fed with fresh inert gas or inert gas which has been cooled to a second, substantially lower temperature of for example—85° C. for purification thereof and then heated again.

Wherever the paper web passes out of ordinary ambient air into an inert gas region or leaves such a region, use is preferably made of an insulating lock device or gas lock region to which fresh inert gas or inert gas which has been purified by low-temperature condensation as set forth in the preceding paragraph is also supplied in such a way that the inert gas flows out of the lock device into the ambient atmosphere but no ambient air can pass into the inert gas region.

In order to minimise the number of such lock devices, it is desirable in a preferred embodiment of the method of the invention for the eight printing mechanisms of a fully equipped rotary intaglio printing machine to be arranged in two towers, that is to say a first-form tower and a perfecting tower, in each case in assemblies of four in mutually superposed relationship, while the four printing regions and the four drying regions of each tower are connected together in terms of inert gas so that each tower will require only one entry lock device and one exit lock device. It is also advantageous for the two towers to be connected together in terms of inert gas so that in all only two lock devices are required. Complete inerting of driers and inking mechanisms can however also be achieved in the case of a conventionally arranged rotary intaglio printing machine in which the printing mechanisms are arranged in horizontal succession.

If the printing process has to be interrupted, depletion or reduction of the content of the waste or exhaust gas by condensation is taken only to such a degree that a concentration value below the above-mentioned figure of 50% of the LEL is reached and ambient air can harmlessly flow into the inert gas region or regions. Further purification of the exhaust or waste gas can then take place in conventional manner, for example using activated carbon filters.

It is preferably possible to provide between the inert gas regions of the individual printing mechanisms and driers sealing arrangements which are opened during the regular printing operation, by means of which however in the event of disturbances or faults in operation or when changing the inking or printing cylinders the printing or inking mechanisms can be separated from the preceding and/or subsequent driers so that it is then possible for individual ones of those regions to be filled with ambient air while the others remain under inert gas.

It will be appreciated that the above-described method in accordance with the principles of the present invention has been set forth merely by way of example and illustration of the invention and that various other modifications and alterations may be made therein without thereby departing from the spirit and scope of the invention.

What is claimed is:

1. A method of drying inks which are printed in a state of being liquefied by means of a solvent onto a paper web in the printing mechanisms of a rotary intaglio printing machine, including:

downstream of each printing mechanism of said rotary intaglio printing machine, passing the paper web through a respective drier which has a substanially closed housing, passing a gas through the respective drier of said rotary intaglio printing machine to receive and carry away the solvent, an inert gas being used as a drying gas in at least one of the driers, and selecting a through-put of the inert gas through said drier of said rotary intaglio printing machine so that a solvent concentration, which is very high in comparison with drying with air occurs in said drier, so that a very rapid drying of ink layers, freshly printed in a printing mechanism preceding said at least one drier, is obtained in order to allow printing of a next ink layer in a respective subsequent printing mechanism of said rotary intaglio printing machine.

2. The method as set forth in claim 1, further including choosing the solvent concentration to be in a range of between 10% and 50% of the saturation limit.

3. The method as set forth in claim 1, further including heating both the paper web and also the drying gas.

4. The method as set forth in claim 3, further including effecting said heating by means of IR-radiation.

5. The method as set forth in claim 1, further including choosing the inert gas to be nitrogen.

6. The method as set forth in claim 1, further including moving the web at high speed, and removing the gas boundary layer, which would otherwise be formed at the surface of the web and be entrained with the web, by turbulence of the gas atmosphere in the drier.

7. The method as set forth in claim 1, further including removing inert gas charged with solvent from the drier, and stripping the inert gas of its solvent content.

8. The method as set forth in claim 7, further including effecting stripping of the inert gas of its solvent content by cooling.

9. The method as set forth in claim 8, further including effecting the cooling to a first lower temperature in order to reduce the solvent content, and again heating inert gas which is stripped off in that way, and therefor recycling the inert gas to the drier.

10. The method as set forth in claim 9, further including effecting cooling, for a part of the inert gas removed from the drier, to a second temperature which is substanially lower than the first temperature in order to achieve almost complete separation of the solvent.

11. The method as set forth in claim 10, further including again heating the inert gas which is cooled to the second temperature, and feeding the again-heated inert gas to a region in which printing is applied to the paper web.

12. The method as set forth in claim 10, further including again heating the inert gas which is cooled to the second temperature, and feeding the again heated inert gas to an insulated lock region for separating an inert gas region from outside air.

13. The method as set forth in claim 10, further including again heating at least part of the inert gas which is cooled to the second temperature, and recycling the again-heated inert gas to the drier to increase the solvent gradient.

14. The method as set forth in claim 7, further including thereafter, again recycling the inert gas, which is removed from the drier to deplete the solvent content, and controlling the said amount of inert gas so that the solvent concentration in the drier remains substanially constant.

15. The method as set forth in claim 7, further including thereafter, again recycling the inert gas, which is removed from the drier to deplete the solvent content, and controlling the degree of solvent depletion so that the solvent concentration in the drier remains substanially constant.

16. The method as set forth in claim 1, further including also effecting operation of printing on the paper web in an inert gas atmosphere.

17. The method as set forth in claim 16, further including causing an inert gas region, in which printing is applied to the paper web and an inert gas region of the drier directly to adjoin each other.

18. The method as set forth in claim 1, further including upon an interruption in a printing procedure, effecting purification of the inert gas by cooling only to a value below 50% of a lower explosion limit at which a post-flow of air without risk can occur, and then, effecting further purification of exhaust gas in another manner.

19. The method as set forth in claim 1, further including using an inert gas in all driers of the rotary intaglio printing machine as a drying gas, and selecting a through-put of the inert gas through at least one drier so that a solvent concentration, which is very high in comparison with drying with air, occurs in the drier.

20. The method as set forth in claim 1, further including using, only in a final drier, an inert gas as the drying gas, and selecting a through-put of the inert gas through the drier so that a solvent concentration which is very high in comparison with drying with air occurs in the drier.

* * * * *